United States Patent [19]

Marks et al.

[11] Patent Number: 4,633,132

[45] Date of Patent: Dec. 30, 1986

[54] SELF-ADHERING CATHODE RAY TUBE BASE

[75] Inventors: Gary T. Marks, Phelps; Charles H. Rehkopf; Fred L. Sorensen, both of Seneca Falls, all of N.Y.

[73] Assignee: North American Philips Consumer Electronics Corp., New York, N.Y.

[21] Appl. No.: 672,519

[22] Filed: Nov. 19, 1984

[51] Int. Cl.[4] ..... H01J 5/54; H01R 33/76

[52] U.S. Cl. ..... 313/477 R; 313/318; 339/144 T

[58] Field of Search ..... 313/477 R, 318; 174/50.51, 50.59, 50.6; 339/14 T, 64 M, 66 T, 75 T, 94 M, 95 T, 144 T, 145 T, 186 T, 182 T

[56] References Cited

U.S. PATENT DOCUMENTS 4,040,707 8/1977 Pisano ..... 313/318 X 4,126,371 11/1978 Puhak ..... 313/318 X

*Primary Examiner*—David K. Moore

*Assistant Examiner*—K. Wieder

*Attorney, Agent, or Firm*—John C. Fox

[57] ABSTRACT

A self-adhering base for a cathode ray tube has a circular array of connector pin apertures, three of which are sized to create a force fit with their associated pins. A first high voltage pin aperture is sized smaller than its associated pin, and the remaining two apertures, which are located approximately equidistantly from the first aperture, are slot-shaped. The slots are oriented to have their long axes intersect the first aperture. Such a self-adhering base is useful both as an in-process base during tube manufacture, and also as a permanent base on the finished tube.

5 Claims, 7 Drawing Figures

SELF-ADHERING CATHODE RAY TUBE BASE

BACKGROUND OF THE INVENTION

This invention relates to bases for cathode ray tubes, and more particularly relates to self-adhering bases which can be used both as an in-process base and a permanent base.

Cathode ray tubes, such as those used for color television and related display applications, have a glass envelope with a face panel portion including a phosphor screen, and a neck portion oriented normal to the face panel and containing an electron gun. In operation, the gun generates electron beams which are swept across the screen in a controlled manner to activate the phosphors and produce a display. These electron beams are generated, focused and accelerated toward the screen by means of a series of discrete components in the gun assembly, including at least one thermionic cathode and a series of electrodes. The beams are generated by the cathode, which is activated by a heater coil. The beams are then focused and accelerated toward the screen by the electrodes, each of which is held at a separate electrical potential chosen to create the desired effect on the beams generated by the cathode.

Because the interior of the tube is held at a vacuum, the electrical leads for the cathode heater and the electrodes are connected to base pins sealed in the glass bottom of the tube neck. The base pins are oriented in a circular array to mate with a socket in the television chassis. In order to provide both mechanical support and electrical insulation for these base pins, the bottom of the tube neck is fitted with a plastic base designed to mate both with the pins and the tube socket. This base typically has a circular basal or bottom portion with a series of pin apertures, an upstanding cylindrical portion called a "lug", and an upstanding shield portion connected to the lug and called a "silo". The basal portion supports a series of truncated cone-shaped walls surrounding the apertures and called "outer beads".

When the tube and base are assembled, the basal portion contacts the bottom of the tube neck and the pins extend through the basal apertures a sufficient distance to mate with the socket. The silo substantially surrounds one pin which is associated with a high voltage electrode, in order to provide arc-over protection for the pins. The silo has an open top to allow electrical connection of the high voltage pin with the socket. In order to provide adherence of the base to the tube, as well as additional electrical insulation between the pins, a bead of a room temperature curable silicone resin, such as silite 100 (a trademark of DEVCON CORP.), is typically applied to the bottom of the base in the pin area prior to assembly.

In the manufacture of cathode ray tubes, it has long been the practice to "process" the tubes after evacuation and sealing of the tube envelope and prior to insertion of the base. Such processing is also known as "high voltage conditioning" and is designed to remove small particles and projections, particularly from the gun assembly, where small inter-electrode spacings would otherwise be prone to high voltage arcing during later tube operation. Typically, specially designed process bases and sockets have been used for this purpose.

It has been recognized that considerable increases in manufacturing efficiencies could be realized by the development of a cathode ray tube base which could be used both as an in-process base during tube manufacture and as a permanent base during tube operation. A principal obstacle to the achievement of this goal has been the lack of either a suitable adhesive or a suitable self-adhering base. The time required for the curing of adhesives which are fully compatible with the manufacturing process is too long to allow the realization of required production speeds. Alternatively, reducing the size of the base apertures to create an adherence sufficient to withstand socket insertion and extraction forces during processing has led to other problems. For example, the normal variation in pin locations among production tubes creates stresses in both the neck and the base, resulting in bent pins, cracks in the neck bottom surrounding the glass-to-metal pin seals, and other problems.

A type of self-adhering base is known which replaces two normally shaped apertures with slot-shaped apertures smaller in width than the pins. The smaller width creates a force fit with the two mating pins, while the slot shape provides a certain amount of accommodation for variations in pin location. However, in practice it has been found that: (1) the adherence provided by the base is insufficient to withstand the normal socket insertion and extraction forces encountered during tube processing; and (2) the slot shaped apertures do not reduce the stresses sufficiently to avoid the pin problems referred to above.

Accordingly, it is an object of the invention to provide a self-adhering base for a cathode ray tube which substantially avoids the above problems while providing sufficient adherence to the tube pins to allow use of the base both as an in-process base and a permanent base.

It is a further object of the invention to provide a self-adhering base for a cathode ray tube which is easily manufacturable, and compatible both with present cathode ray tube designs and cathode ray tube manufacturing processes.

In accordance with the invention, there is provided a cathode ray tube base having: a bottom or basal portion defining an array of apertures for mating with an array of cathode ray tube pins extending from the bottom of the neck of the tube, each aperture surrounded by a wall or bead upstanding from the basal portion; the base also having: a cylindrical portion upstanding from the central portion of the basal portion; the base may also have an open-topped shield portion surrounding at least one of the pin apertures and its associated bead, for shielding a high voltage pin.

In accordance with the self-adhering aspects of the base, a first one of the apertures has a smaller opening than that of its associated pin, preferably a shielded aperture, and two other of the apertures are slot-shaped, the three apertures located approximately equidistantly from one another, and the two slot-shaped apertures oriented to have their long axes intersect the approximate location of the first aperture. Slots are oriented in a direction to relieve the direction of stress at the stem leads.

In accordance with a preferred embodiment, the apertures are distributed in a circular array and the long axes of the slots form an angle with a line bisecting both the first aperture and the array, the angle within the range of about 20 to 30 degrees.

In accordance with another preferred embodiment, the side walls of the slot-shaped apertures each have a planar portion and a concave conical portion, the ratio of the slot width to its associated pin width is within the range of about 0.37 to 0.51, which ratios have been found to result in optimum pin retention force without undue stress on either the base, the pins, or the glass-to-metal pin seal in the neck.

DETAILED DESCRIPTION OF THE INVENTION

Figure 1:
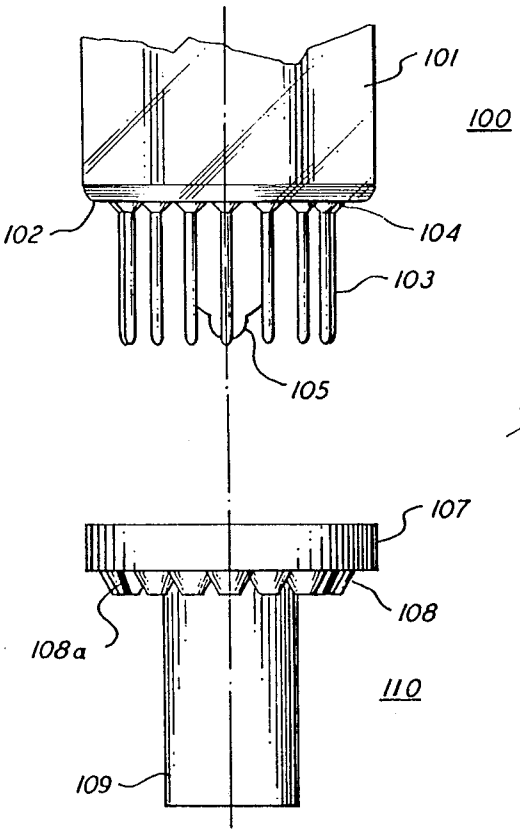
FIG. 1 is a front elevation assembly view of the bottom portion of a cathode ray tube neck and its associated base.

Referring now to FIG. 1, there is shown a front elevation assembly view of a bottom portion 100 of a CRT and a base 110. Bottom portion 100 includes glass neck 101 having a bottom portion 102, and a circular array of connector pins 103 protruding from bottom portion 102 a sufficient distance to make electrical contact with a mating socket, not shown. The pins form glass-to-metal seals 104 with the bottom 102, and protrude into the interior of the neck's interior, where they make electrical connections to various components of the gun assembly, also not shown. Also extending from the bottom of the neck is exhaust tubulation 105, the remnant of a glass tube used to exhaust the CRT during manufacture, and sealed by radiant heating at about the pin level following exhaust.

Base 110, fabricated from a moldable plastic composition having electrical insulating properties, such as Celanex 3210 (polybutylene terephthalate from Celanese Corp.) includes basal or bottom portion 107, defining a circular array of apertures sized and located for mating with the pin array, each aperture surrounded by a supporting wall or "bead" 108, the outer surface is sloped to form a truncated cone. These beads, in addition to providing mechanical support, provide arc-over protection between adjacent pins. Extending from the central portion of the basal portion 107 is a cylindrical portion or "lug" 109, sized and positioned to form a protective cover over the exhaust tubulation 105.

Figure 2:
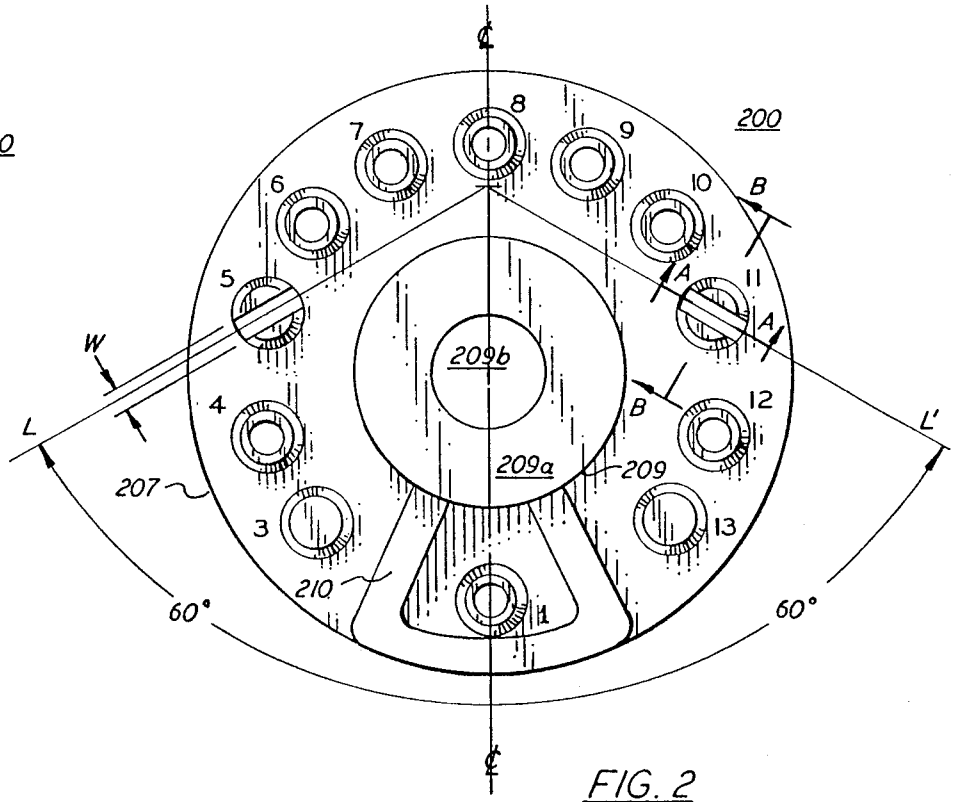
FIG. 2 Prior Art
FIG. 2 is a top view of a self-adhering base of the prior art having two slotted apertures.

Referring now to FIG. 2, there is shown a top view of a type of self-adhering base 200 known in the prior art. In addition to the self-adhering features to be described, this view shows conventional features not shown in FIG. 1, such as upstanding shielding portion or "silo" 210, extending from the bottom 207 of base 200 to approximately pin height, and extending from the lug 209 on either side of high voltage pin aperture 1 to completely surround the aperture and provide additional protection from arc-over to adjacent aperture. Also shown is a conventional top cap **209*a* for lug 209, defining aperture 209*b*** whose function is to allow entry of air to aid in curing of the adhesive after the base is seated.

Referring now to the self-adhering features of the base 200, there are provided two slot-shaped apertures 5 and 11, each having a slot width "w" less than the pin width by an amount sufficient to provide a force fit between the aperture and the pin. The slots are oriented to have their long axes L and L′ form an angle of about 60 degrees with the centerline C of the base, said centerline located to bisect apertures 1 and 8. Such orientation accommodates a certain amount of variation in pin location from one CRT to another, so long as such variation occurs along either of the long axes L and L′.

Figure 3:
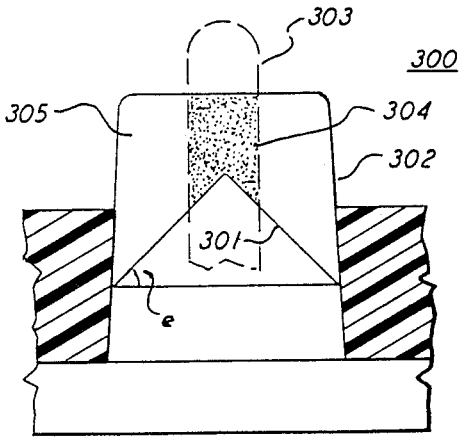
FIG. 3 Prior Art
FIG. 3 is a section view of one of the slotted apertures of the base of FIG. 2, the section taken along the long axis of the slot.
Figure 4:
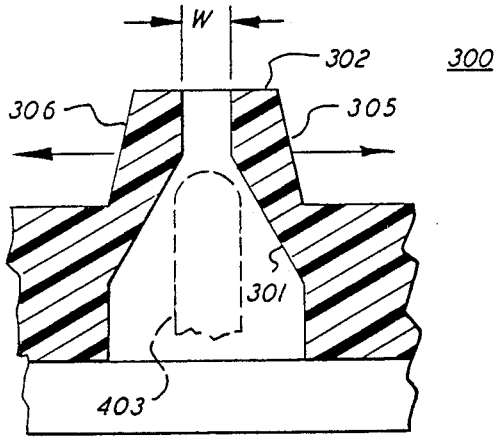
FIG. 4 Prior Art
FIG. 4 is a section view of the slot of FIG. 3, taken transverse to the long axis of the slot.

Referring now to FIGS. 3 and 4, section views of aperture 11 along lines A and B of FIG. 2, respectively, it is seen that a portion of the inner wall 301 of bead 300 is conically shaped at a substantially steeper angle than that of outer wall 302. This construction is typical for all of the apertures, and serves to guide slightly misaligned pins into the apertures. In FIG. 3, a pin 303 is shown in phantom partially inserted into aperture 11. The shaded area 304 indicates the approximate area of contact between the pin and the sidewall 305 of the slot. FIG. 4 shows a pin 403 about to be inserted into aperture 11. As will be appreciated, sidewalls 305 and 306 must flex outwardly to accommodate pin 403, due to the narrower width of the slot. After insertion, the natural elasticity of the base material causes the sidewalls to reflex and hold the pin in the aperture. The flexural force together with the frictional force between the pin and the aperture in the contact area determine the total adherent force needed to insert and extract the pin.

As stated above in the Background of the Invention, it has been found in practice that the adherent force of the above prior art design is inadequate to withstand the repeated socket insertions and extractions encountered during CRT manufacture and later use. In addition, it has been found that the location and orientation of the slots does not alleviate the effects of stresses caused by random pin misalignments occurring during CRT mamufacture.

Figure 5:
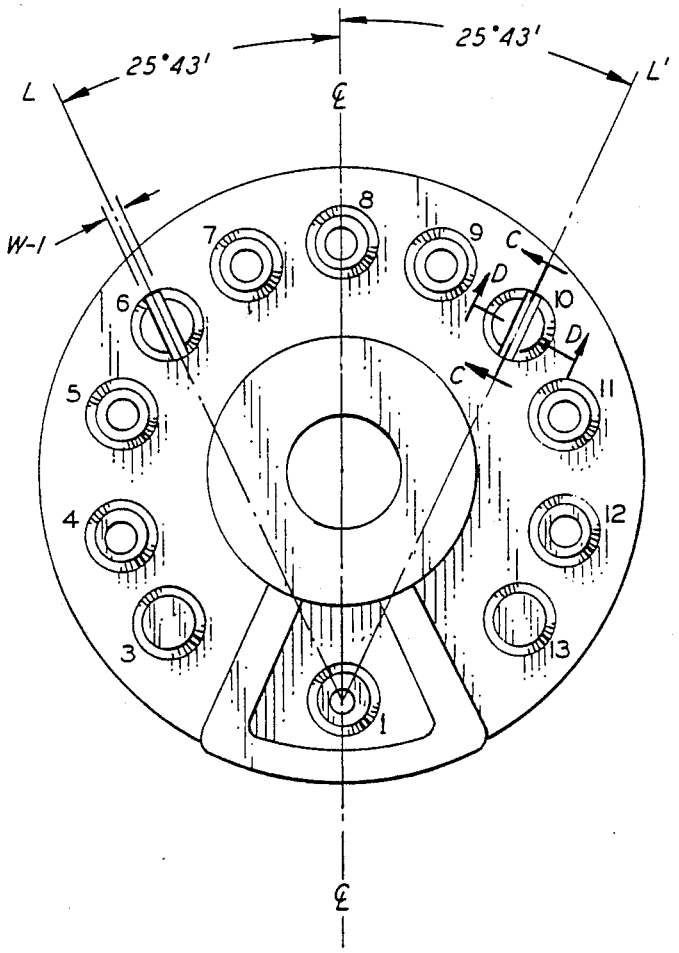
FIG. 5 is a top view of a self-adhering base of the invention having a small aperture and two associated slotted apertures oriented to be in line with the small aperture.

A substantially improved self-adherent base in accordance with the invention is shown in top view in FIG. 5. Three apertures, 1, 6 and 10, are sized to produce a force fit with their mating pins, and are spaced approximately equidistantly from each other. Aperture 1, in the high voltage pin position, is circular, but smaller than the remaining circular apertures 4, 5, 7, 8, 9, 11 and 12 by an amount sufficient to create a force fit with its mating high voltage pin. As will be appreciated, this arrangement creates a significant adherent force due to the fact that the sidewall of the bead completely surrounds and makes contact with the mating pin. In addition, this tight contact forms a seal between the pin and the aperture which prevents Silite 100 or other adhesive used between the base and the CRT neck from passing through the aperture to cover a portion of the protruding pin where it could possibly interfere with the making of a good electrical contact with the mating socket.

Located approximately equidistantly from tight aperture 1 are two slotted apertures 6 and 10, each having a width w-2 less than its mating pin width w-1 by an amount sufficient to create a force fit between the pin and the aperture. In accordance with one aspect of the invention, the slots are oriented to have their long axes L and L′ intersect aperture 1. This orientation has been found in practice to accommodate a considerable number of variations in pin location, thus substantially alleviating the stress-related conditions of radial cracks in the neck glass, misaligned pins and separation of the adhesive from the neck and base. This orientation of the slots can be further defined by the angle which the long axes L and L′ make with the centerline C, such angle being 25 degrees 43 minutes in the embodiment shown in FIG. 5.

Figure 6:
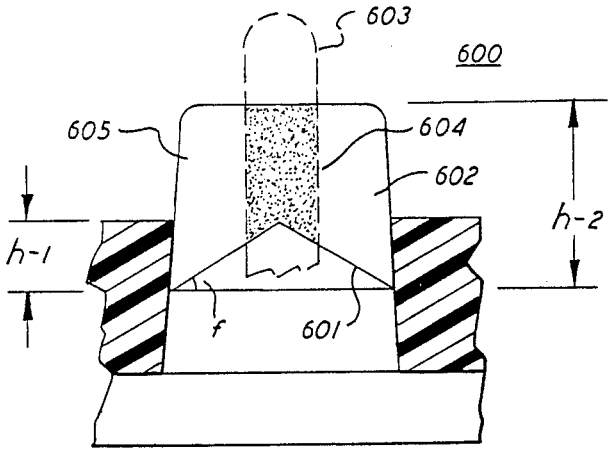
FIG. 6 is a section view of one of the slotted apertures of the base of FIG. 5, the section taken along the long axis of the slot.
Figure 7:
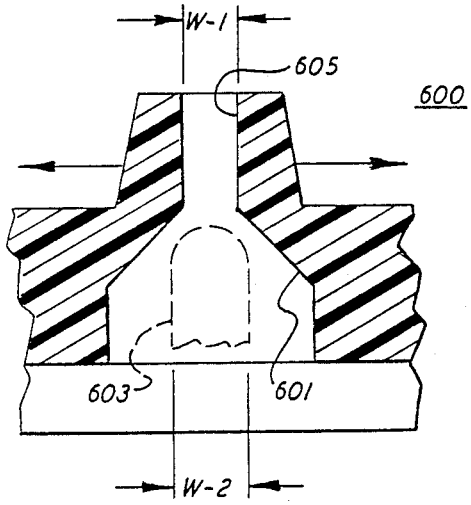
FIG. 7 is a section view of the slot of FIG. 6, taken transverse to the long axis of the slot.

Referring now to FIGS. 6 and 7, section views of aperture 10 along lines C and D respectively, there is shown another aspect of the invention in which the contact area 604 is significantly increased over that of the prior art base of FIG. 3. This is accomplished by decreasing the angle "f" defining the slope of the conical portion 601 of the aperture sidewall 602. Because of this increase in the contact area between the pin and the aperture, the frictional component of the adherent force is also increased, thus improving the overall self-adherence of the base.

Since in practice, it is difficult to measure the actual area of contact between the aperture and the pin, the ratio of the height "h-1" of the cone vertex to the height "h-2" of the planar portion 605 of the sidewall 602 can be used as an indication of such area, since such ratio is proportional to such contact area for a given pin width.

For specific applications, it will be necessary to select a combination of slot width w-1, pin width w-2, cone vertex height h-1 and sidewall height h-2 to achieve the desired insertion and extraction forces. In general, a ratio of slot width w-1 to pin width w-2 within a range of from about 0.66 to 0.80, and a ratio of cone height h-1 to sidewall height h-2 within the range of about 0.37 to 0.51 will result in an extraction force of from about 9 to 13 pounds, which will be found to be satisfactory for most applications. In the specific embodiment shown, a slot width w-1 of about 0.029 Inch, a pin width W-2 of about 0.039 Inch, a cone height h-1 of about 0.048 Inch, and a sidewall height h-2 of about 0.108 Inch, result in ratios of about 0.74 and 0.44 respectively, and an extraction force of about 11 pounds.

While there have been shown and described what are at present considered to be the preferred embodiments of the invention, other embodiments are intended to be included within the scope of the appended claims. For example, the number of apertures and the location of the tight aperture and the slotted aperture may vary with the intended application.

What is claimed is:

1. A self-adhering cathode ray tube base comprising:

a bottom portion defining a circular array of apertures for mating with an array of cathode ray tube connector pins extending from the bottom of the neck of the tube, each aperture surrounded by a wall upstanding from the bottom portion, and first and second ones of the apertures being slot-shaped; and a cylindrical portion upstanding from the central portion of the bottom portion, for forming a protective cover for an exhaust tubulation extending from the bottom of the neck;

characterized in that a third one of the apertures has a smaller opening than that of its associated pin, and the two slot-shaped apertures oriented to have their long axes intersect the approximate location of the third aperture to form an angle with a line bisecting both the third aperture and the array, the angle within the range of about 20 to 30 degrees.

2. The base of claim 1 including a shield portion surrounding at least one of the pin apertures and its associated wall, for shielding a high voltage pin.

3. The base of claim 1 in which the first aperture is surrounded by the shield portion.

4. The base of claim 1 in which the slot-shaped apertures have slots of width "w-1", such width "w-1" having a ratio to width "w-2" of the associated pin within the range of about 0.66 to 0.80, and in which the slot-shaped apertures have sidewalls including a conical portion of height "h-1" and a planar portion of height "h-2", such height "h-1" having a ratio to height "h-2" within the range of about 0.37 to 0.51 which ratio is proportional to the contact area between the apertures and their associated pins.

5. The base of claim 1 in which a layer of adhesive is located between the bottom of the tube neck and the bottom of the base, at least in the area surrounding the high voltage aperture and its associated pin.

* * * * *